US008831468B2

(12) United States Patent
Yuki

(10) Patent No.: US 8,831,468 B2
(45) Date of Patent: Sep. 9, 2014

(54) OPTICAL SCANNER AND IMAGE FORMING DEVICE

(71) Applicant: KYOCERA Document Solutions Inc., Osaka (JP)

(72) Inventor: Uohashi Yuki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/088,962

(22) Filed: Nov. 25, 2013

(65) Prior Publication Data

US 2014/0119768 A1 May 1, 2014

(30) Foreign Application Priority Data

Oct. 24, 2012 (JP) ..... 2012-234938

(51) Int. Cl.

| | |
|---|---|
| ***G03G 21/00*** | (2006.01) |
| ***B41J 2/435*** | (2006.01) |
| ***B41J 27/00*** | (2006.01) |
| ***G03G 21/16*** | (2006.01) |

(52) U.S. Cl.

CPC ..... *G03G 21/00* (2013.01); *G03G 21/1666* (2013.01)

USPC ..... 399/98; 399/351; 399/357; 347/224; 347/256

(58) Field of Classification Search

USPC ..... 399/98, 351, 357; 347/224, 256

See application file for complete search history.

(56) References Cited

FOREIGN PATENT DOCUMENTS

| | | | |
|---|---|---|---|
| JP | 2009-143108 | | 7/2009 |
| JP | 2009143108 A | * | 7/2009 |
| JP | 2011158566 A | * | 8/2011 |

* cited by examiner

*Primary Examiner* — Sarah Al Hashimi

(74) *Attorney, Agent, or Firm* — Wenderoth, Lind & Ponack, L.L.P.

(57) ABSTRACT

An optical scanner includes a plurality of automatic cleaning units which automatically cleans dust-proof glasses. The automatic cleaning units include screw shafts threadedly coupled to holding units that hold cleaning members. When the holding members are moved by rotationally driving the screw shafts of the automatic cleaning units at the same time, the height of the cleaning member of at least one of the automatic cleaning units with respect to the dust-proof glasses becomes different from the height of the cleaning members of the remaining automatic cleaning units with respect to the dust-proof glasses.

9 Claims, 11 Drawing Sheets

OPTICAL SCANNER AND IMAGE FORMING DEVICE

CROSS-REFERENCE TO RELATED APPLICATION(S)

This application is based upon and claims the benefit of priority from Japanese Patent Application(s) No. 2012-234938 filed on Oct. 24, 2012, the entire contents of which are incorporated herein by reference.

BACKGROUND

In an image forming device such as a copier or a printer which employs an electrophotography, light for the writing of electrostatic latent images is irradiated from an optical scanner onto a photoreceptor (an image carrier) uniformly charged by a charging means. Electrostatic latent images are formed on the photoreceptor. Thereafter, the respective electrostatic latent images are developed by a developing device through the use of a tonner and are manifested as tonner images.

The optical scanner accommodates a scanning optical system which emits light for the writing of electrostatic latent images toward the photoreceptor. The optical scanner includes an emission port through which light is emitted from the scanning optical system and a dust-proof glass (a cover glass) which covers the emission port. For example, a color image forming device includes four emission ports and four dust-proof glasses covering the emission ports, which are provided in one-to-one correspondence to four colors of magenta (M), cyan (c), yellow (Y) and black (B).

In this optical scanner, optical properties grow worse if dirt or dust adheres to the surfaces of the dust-proof glasses. For that reason, it is necessary to periodically clean the surfaces of the dust-proof glasses. There has been proposed an automatic cleaning mechanism for periodically cleaning the surfaces of the dust-proof glasses. For example, there has been proposed an automatic cleaning mechanism configured to move four cleaning members in a long-side direction (longitudinal direction) of four cover glasses using four screw shafts so that the four cover glasses can be cleaned at the same time.

However, the aforementioned automatic cleaning mechanism is configured such the four cover glasses are cleaned at the same timing as the four cleaning members are moved by a single motor. Therefore, the load applied to the motor at that time becomes higher. It is therefore necessary to employ a high-output expensive motor. This becomes one cause of escalating device costs.

In view of the circumstances mentioned above, it is an object of the technology of the present disclosure to provide an optical scanner capable of reducing a load applied to a motor during a cleaning process and eventually making it possible to use a relatively cheap motor

SUMMARY

An optical scanner according to one aspect of the present disclosure includes a frame configured to accommodate a plurality of scanning optical systems for emitting latent-image-writing light toward an image carrier and provided with a plurality of emission ports through which the light emitted from the scanning optical systems passes. The optical scanner further includes a plurality of dust-proof glasses configured to cover the emission ports and a plurality of automatic cleaning units respectively driven by one drive source to clean the dust-proof glasses.

Each of the automatic cleaning units includes a screw shaft arranged to extend along each of the dust-proof glasses and rotationally driven by the drive source, a holding member to which the screw shaft is threadedly coupled, and a cleaning member held by the holding member and configured to, when the screw shaft is rotationally driven, move together with the holding member along each of the dust-proof glasses to clean each of the dust-proof glasses. The automatic cleaning units are configured such that, when the holding members of the automatic cleaning units are moved by rotationally driving the screw shafts of the automatic cleaning units at the same time, the height of the cleaning member of at least one of the automatic cleaning units with respect to each of the dust-proof glasses becomes different from the height of the cleaning members of the remaining automatic cleaning units with respect to the dust-proof glasses.

An image forming device according to another aspect of the present disclosure includes the aforementioned optical scanner.

DETAILED DESCRIPTION

The present embodiment will now be described with reference to the drawings. In the figures described below, the scale of individual members is appropriately changed in order to show the individual members at a recognizable size.

Figure 1:
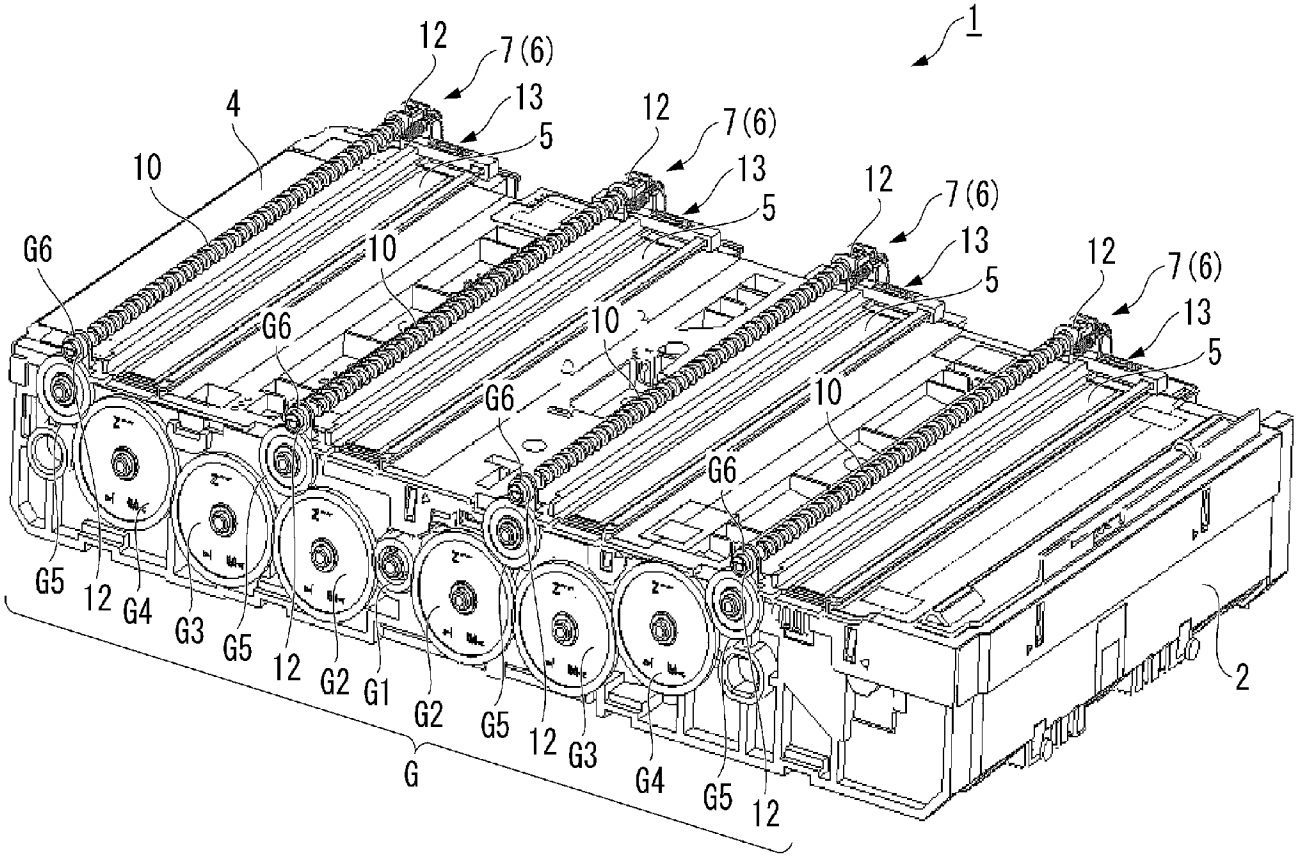
FIG. 1 is an oblique top perspective view showing an optical scanner according to one embodiment.
Figure 2:
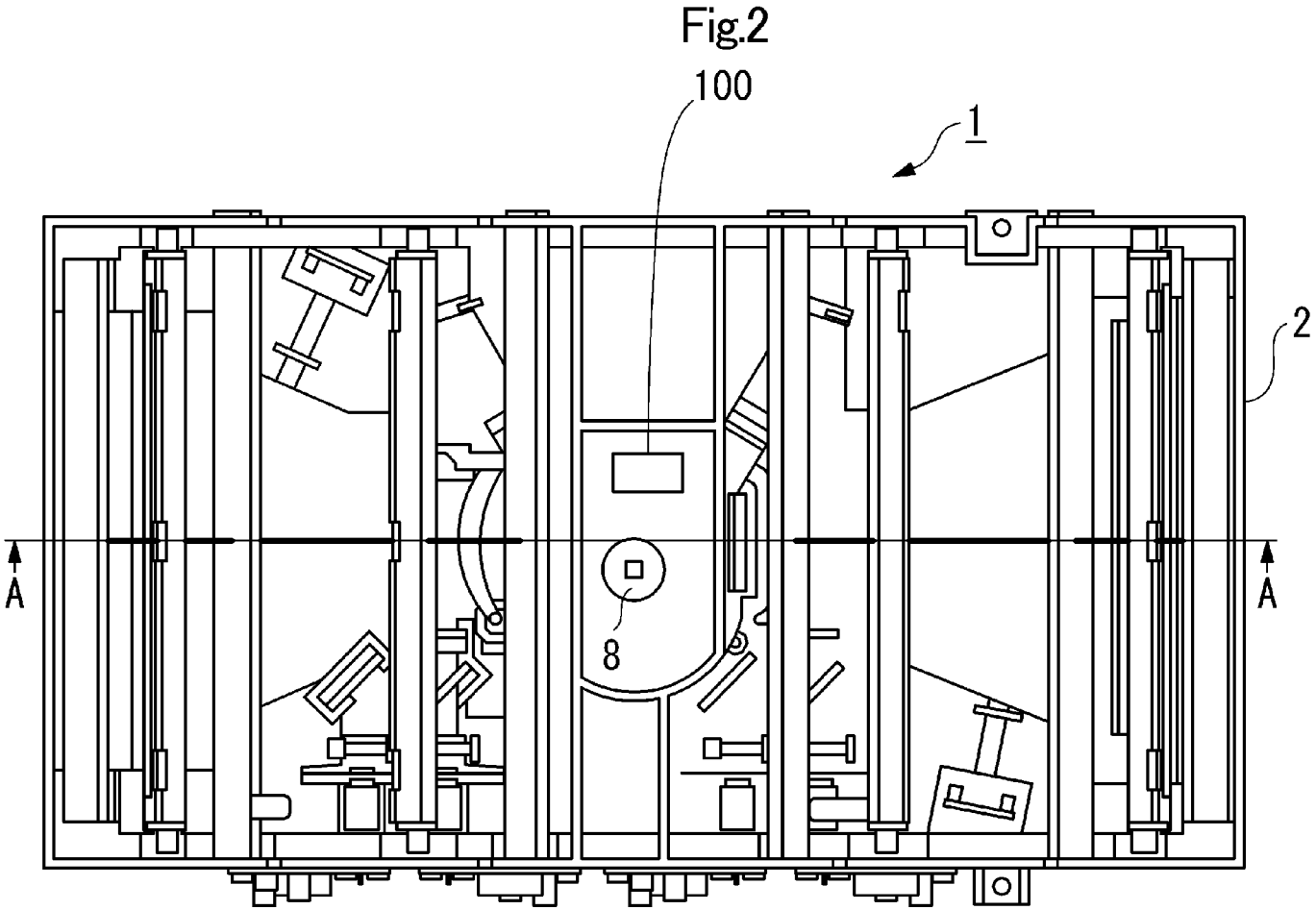
FIG. 2 is a plan view of the optical scanner according to one embodiment.
Figure 3:
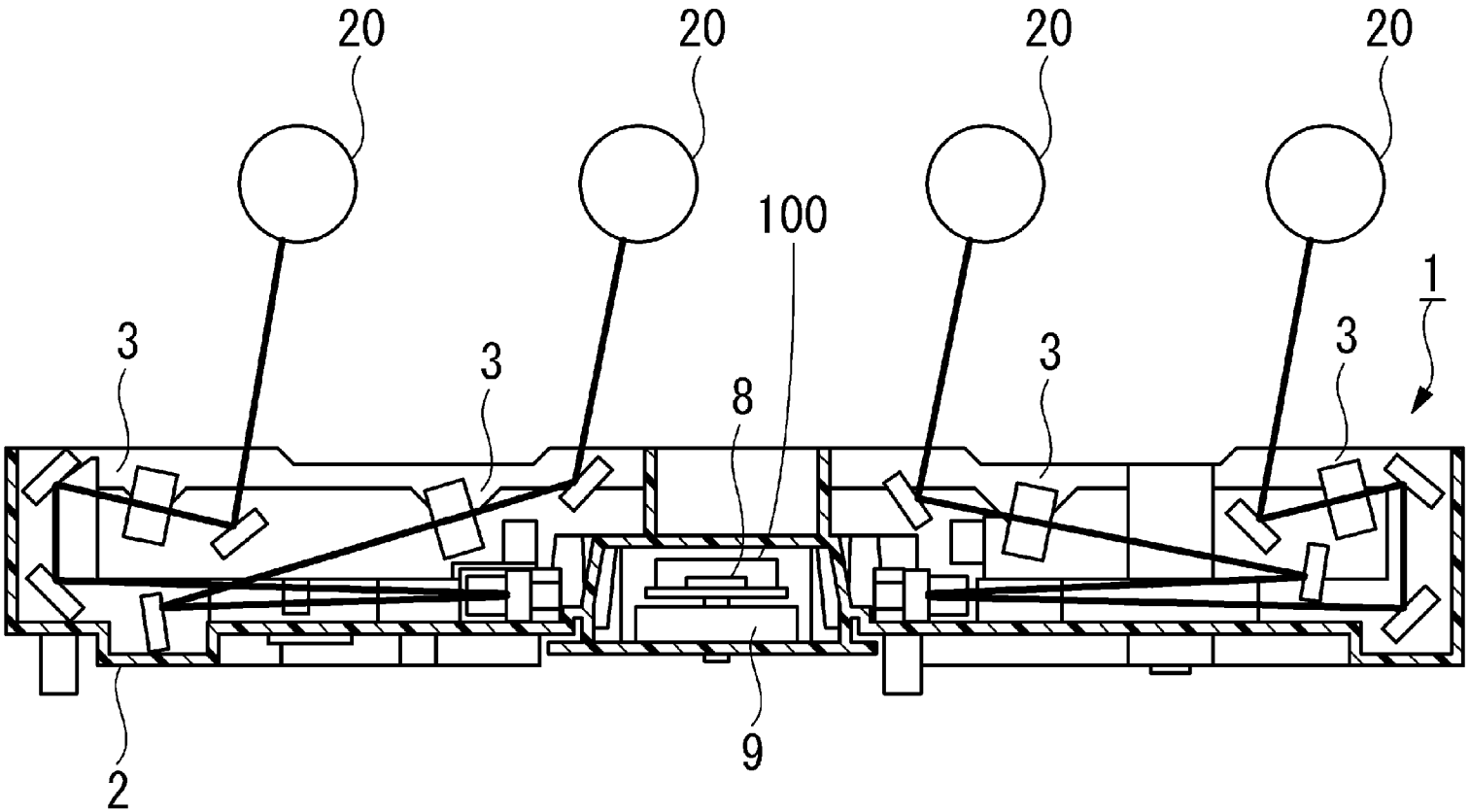
FIG. 3 is a section view taken along line A-A in FIG. 2.

FIG. 1 is an oblique top perspective view showing an optical scanner according to one embodiment. FIG. 2 is a plan view of the optical scanner. FIG. 3 is a section view taken along line A-A in FIG. 2.

Reference symbol 1 used in these figures designates an optical scanner. The optical scanner 1 is a laser scanning unit (LSU) provided in an image forming device such as a copier or a printer which employs an electrophotography, particularly in a color image forming device in which a plurality of photosensitive drums (image carriers) are arranged side by side as shown in FIG. 3. The color image forming device shown in FIG. 3 is one embodiment of an image forming device.

As shown in FIG. 3, four scanning optical systems 3 which emit laser light for the writing of electrostatic latent images toward four photosensitive drums 20 corresponding to individual colors of magenta (M), cyan (c), yellow (Y) and black (B) are accommodated within a rectangular box-shaped frame (housing) 2 of the optical scanner 1. The scanning optical systems 3 are arranged in tandem along a long-side direction of the frame 2 (along a left-right direction in FIG. 3).

A cover 4 for covering the top surface of the frame 2 is installed on the frame 2 as illustrated in FIG. 1. Four emission ports (not shown) having an elongated rectangular shape through which laser light emitted from the four scanning optical systems 3 can pass are formed in the cover 4. These emission ports are covered with transparent dust-proof glasses (cover glasses) 5 which transmit light therethrough. In this regard, the respective emission ports and the dust-proof glasses 5 covering the emission ports are formed into an elongated rectangular shape such that, as shown in FIG. 3, the length direction of the long side thereof (hereinafter called "the long-side direction") extend in the main scanning direction of the laser light with respect to the photosensitive drums 20 (in the direction perpendicular to the drawing sheet plane in FIG. 3).

The surfaces of the respective dust-proof glasses 5 are automatically cleaned by automatic cleaning units 7 of an automatic cleaning mechanism 6 shown in FIG. 1. The automatic cleaning mechanism 6 is one embodiment of an automatic cleaning mechanism. Description will now be made on the automatic cleaning mechanism 6. The automatic cleaning mechanism 6 including four automatic cleaning units 7 is installed in the optical scanner 1. The four dust-proof glasses 5 are respectively cleaned by the respective automatic cleaning units 7.

In the present embodiment, as shown in FIGS. 2 and 3, a drive motor 100 (a drive source) which drives the respective automatic cleaning units 7 is arranged in the long-side-direction central portion of the frame 2. More specifically, as shown in FIG. 3, a single polygon mirror (rotary polygon mirror) 8 common to the plurality of scanning optical systems 3 and a polygon motor 9 for rotationally driving the polygon mirror 8 are arranged in the central portion of the frame 2. The drive motor 100 is arranged at one side (transverse side) of the polygon mirror 8 and the polygon motor 9. A reversible motor is used as the drive motor 100. All the automatic cleaning units 7 are configured to be driven by the drive motor 100, namely the same drive motor.

Figure 4:
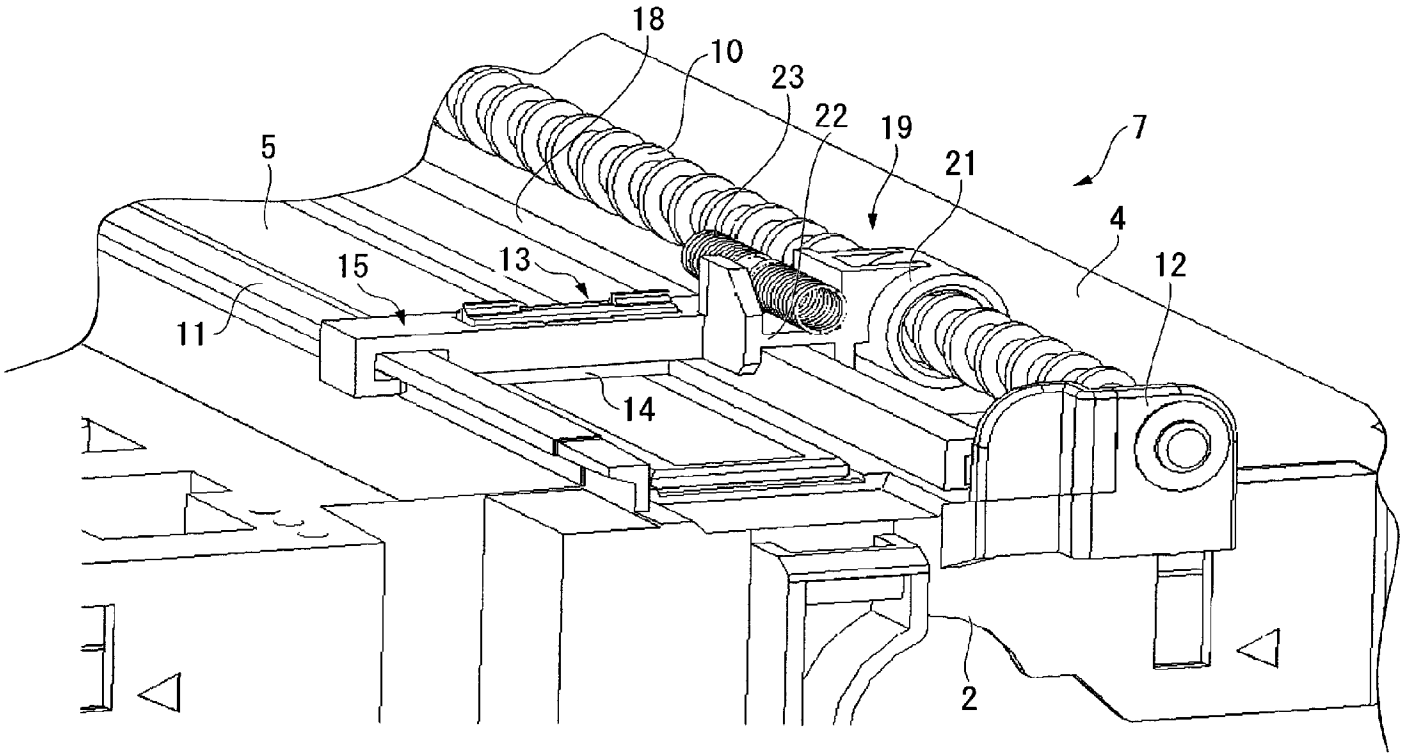
FIG. 4 is a perspective view showing a schematic configuration of an automatic cleaning unit.

As shown in FIGS. 1 and 4, each of the automatic cleaning units 7 includes a screw shaft 10 arranged on the cover 4 attached to the upper surface of the frame 2 so as to extend along the main scanning direction of laser light, namely the length direction of the long side (the long-side direction) of the dust-proof glass 5, a guide rail 18 arranged between the screw shaft 10 and the dust-proof glass 5 so as to extend along the long-side direction of the dust-proof glass 5, and a guide member 11 arranged at the opposite side of the dust-proof glass 5 from the screw shaft 10 so as to extend along the long-side direction of the dust-proof glass 5. The axial opposite ends of the screw shaft 10 are held by bearings 12 so that the screw shaft 10 can rotate in the forward and reverse directions.

Figure 5:
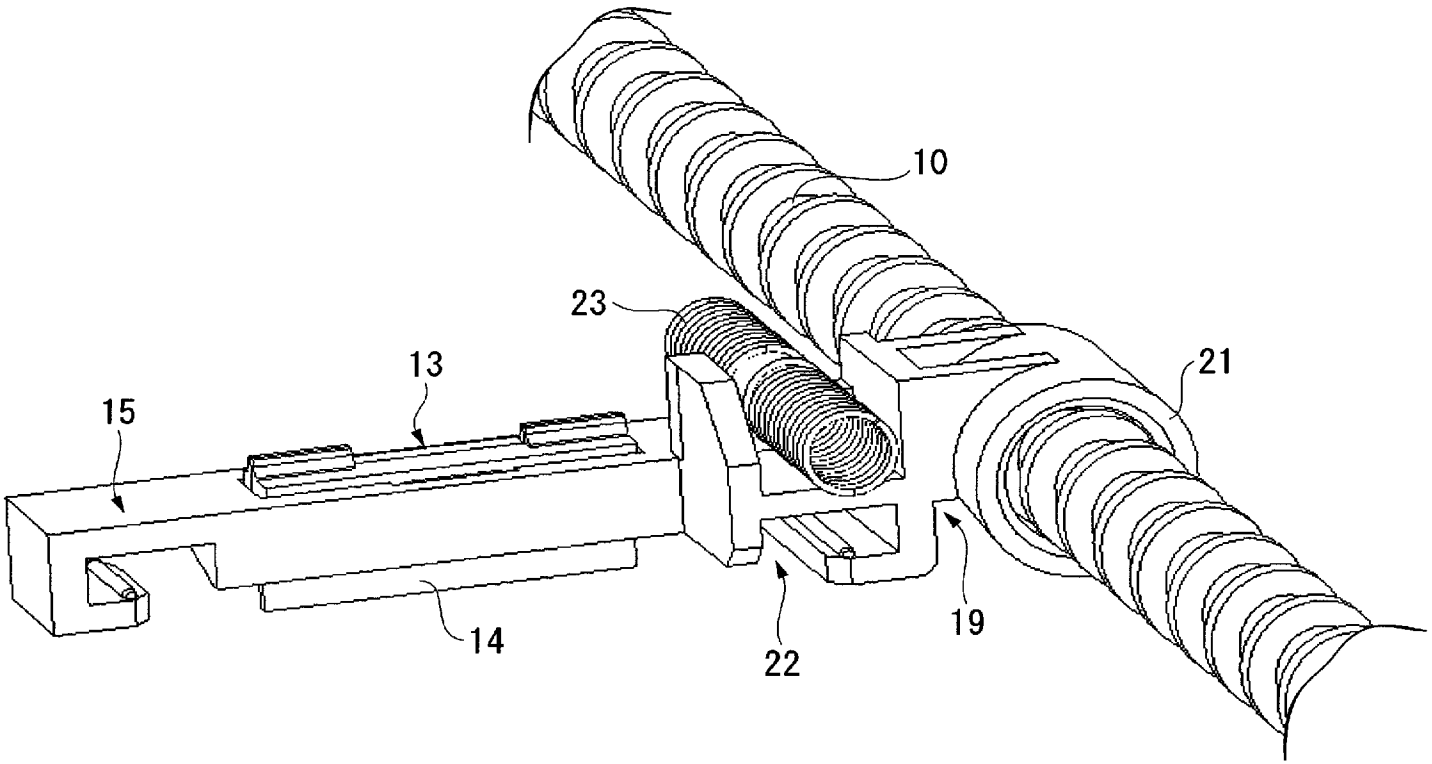
FIG. 5 is a perspective view showing a screw shaft, a holding portion, a cleaning member and a sliding portion.

As depicted in FIGS. 4 and 5, each of the automatic cleaning units 7 includes a holding member 13 threadedly coupled to the screw shaft 10, a cleaning member 14 protruding from the lower surface of the holding member 13, a base portion 19 installed in the holding member 13 at the side of the screw shaft 10, and a sliding portion 15 installed in the holding member at the opposite side of the dust-proof glass 5 from the screw shaft 10. The cleaning member 14 is formed of an elastic plate member, e.g., a silicon pad. The cleaning member 14 is installed in a position where the cleaning member 14 overlaps with each of the dust-proof glasses 5 when seen in a plan view, namely in a position where the cleaning member 14 can press and frictionally clean the surface of each of the dust-proof glasses 5.

Figure 6A:
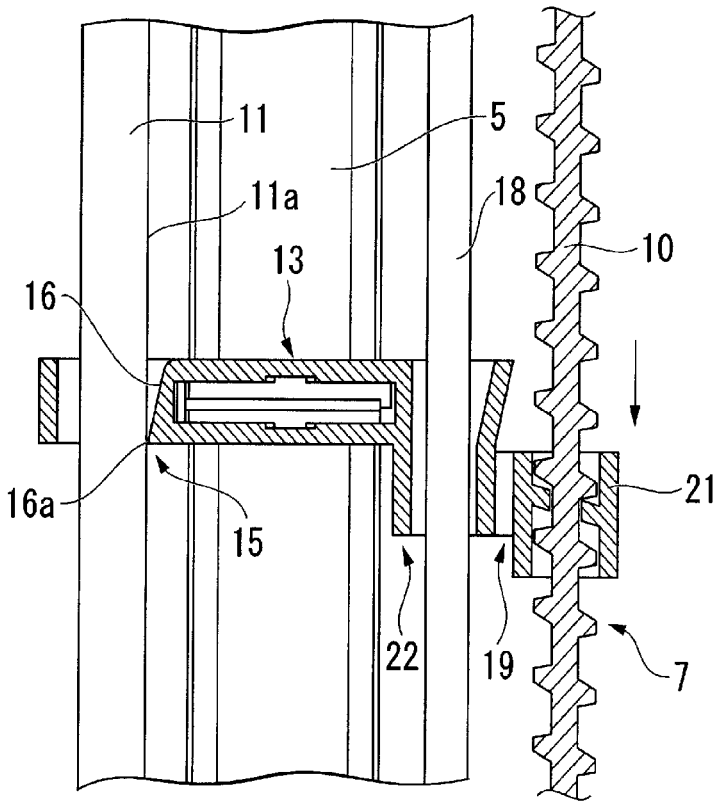
FIG. 6A is a sectional plan view of the automatic cleaning unit with the top portion thereof cut away.
Figure 6B:
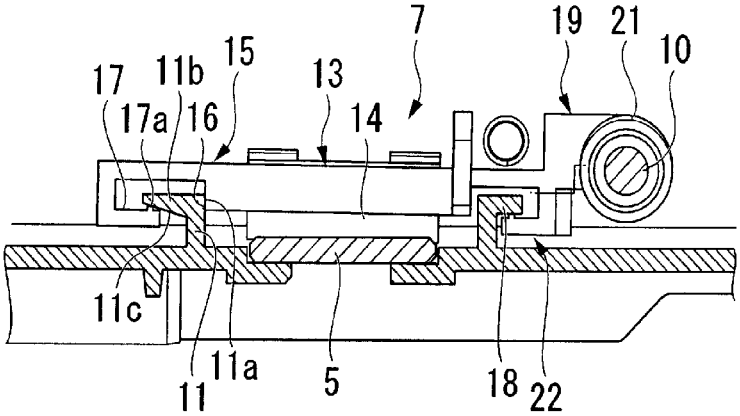
FIG. 6B is a front view showing the automatic cleaning unit and its vicinities.

As illustrated in FIG. 4, the sliding portion 15 slidably engages with the guide member 11. As shown in FIG. 6A which is a sectional plan view of the automatic cleaning unit 7 with the top portion thereof cut away and in FIG. 6B which is a front view showing the automatic cleaning unit 7 and its vicinities, the sliding portion 15 includes a first sliding surface 16 which slides (can slide) along a side surface 11*a* of the guide member 11 facing toward the dust-proof glass 5. As illustrated in FIG. 6B, the guide member 11 is formed into an inverted L-like shape when seen in a front view. The lower surface of a protrusion portion 11*b* of the guide member 11 protruding away from the dust-proof glass 5 is defined as a second sliding surface 11*c* belonging to the guide member 11.

The sliding portion 15 is formed such that, at the opposite side from the screw shaft 10, the sliding portion 15 covers the upper surface of the protrusion portion 11*b*, turns around the outer end of the protrusion portion 11*b* and then makes contact with the second sliding surface 11*c*. The surface of the sliding portion 15 which makes contact with the second sliding surface 11*c* is defined as a second sliding surface 17 belonging to the sliding portion 15. That is to say, the second sliding surface 11*c* of the guide member 11 and the second sliding surface 17 of the sliding portion 15 are arranged to make contact with each other. As will be described later, the second sliding surface 17 of the sliding portion 15 slides with respect to the second sliding surface 11*c* of the guide member 11 along with the movement of the holding member 13.

In the present embodiment, a protuberance 17*a* making sliding contact with the second sliding surface 11*c* of the guide member 11 is formed in the tip end region of the second sliding surface 17 of the sliding portion 15 so as to extend along the length direction of the guide member 11 (the long-side direction of the dust-proof glass 5). Thus, in reality, only the protuberance 17*a* of the second sliding surface 17 makes sliding contact with the second sliding surface 11*c* of the guide member 11. With this configuration, the sliding portion 15 includes the first sliding surface 16 and the second sliding surface 17 and hence engages with the guide member 11. That is to say, the first sliding surface 16 and the second sliding surface 17 make up an engaging portion which engages with the guide member 11.

The base portion 19 includes a thread coupling section 21 threadedly coupled to the screw shaft 10 and an engaging section 22 slidably engaging with the guide rail 18. When the sliding portion 15 of the holding member 13 is swung as will be described later, the base portion 19 serves as a center of the swing movement. The sliding portion 15 of the holding member 13 is configured to swing only when the holding member moves forward or backward as will be mentioned later, namely when the holding member 13 moves in one direction.

Figure 7A:
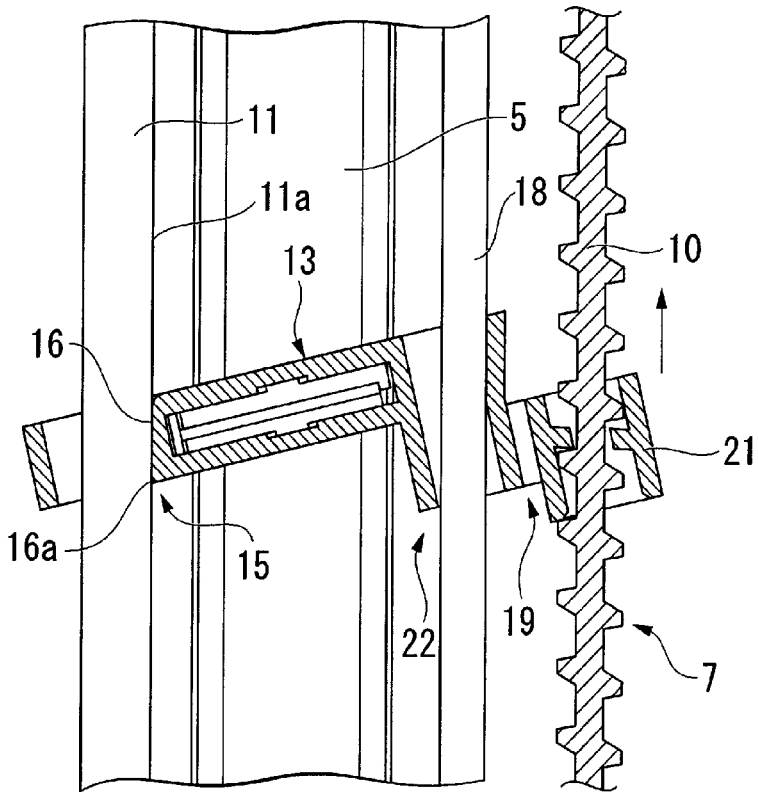
FIG. 7A is a sectional plan view of the automatic cleaning unit with the top portion thereof cut away.

More specifically, the thread coupling section 21 and the engaging section 22 are formed into such a shape that, when the sliding portion 15 of the holding member 13 kept in the initial setting state shown in FIG. 6A is swung as shown in FIG. 7A which is a sectional plan view of the automatic cleaning unit 7 with the top portion thereof cut away, the thread coupling section 21 and the engaging section 22 can escape from the screw shaft 10 and the guide rail 18 with no interference of the screw shaft 10 and the guide rail 18. Thus, the sliding portion 15 of the holding member 13 can swing about the base portion 19. In contrast, if the sliding portion 15 makes an attempt to swing in the direction opposite to the direction in which the sliding portion 15 is swung from the state shown in FIG. 6A to the state shown in FIG. 7A, the thread coupling section 21 interferes with the screw shaft 10 and the engaging section 22 interferes with the guide rail 18. Therefore, the sliding portion 15 cannot swing in the opposite direction. As shown in FIGS. 4 and 5, an operation return spring 23 is installed above the base portion 19.

In the present embodiment, as shown in FIG. 6A, the first sliding surface 16 of the sliding portion 15 is a slant surface which is inclined with respect to the moving direction of the holding member 13, namely the long-side direction of the dust-proof glass 5, when the sliding portion 15 is not swung and kept in the initial setting state. The inclination angle of the slant surface (the first sliding surface 16) is not particularly limited but may be appropriately set so as to obtain a necessary swing amount.

Since the sliding portion 15 has the first sliding surface 16 formed of the slant surface, the sliding portion 15 can be swung in the direction opposite to the moving direction (forward movement direction) of the holding member 13 when the holding member 13 is moved forward or backward by the rotation of the screw shaft 10, e.g., when the holding member 13 is moved forward as indicated by an arrow in FIG. 7A. On the other hand, when the holding member 13 is moved backward as indicated by an arrow in FIG. 6A, the sliding portion 15 does not make any swing movement but maintains the initial setting state.

In other words, the first sliding surface 16 is a slant surface which is inclined with respect to the moving direction of the holding member 13 in the initial setting state shown in FIG. 6A. Therefore, when the holding member 13 is moved backward as indicated by an arrow in FIG. 6A, the end edge 16*a* of the slant surface 16 protruding toward the guide member 11 becomes a leading edge in the moving direction (the arrow direction). At this time, friction is generated by sliding between the end edge 16*a* and the side surface 11*a* of the guide member 11. Thus, the end edge 16*a* is pulled in the direction opposite to the arrow direction. For that reason, if the sliding portion 15 makes an attempt to swing in the direction opposite to the direction indicted by an arrow in FIG. 6A, the thread coupling section 21 interferes with the screw shaft 10 and the engaging section 22 interferes with the guide rail 18 as set forth above. Therefore, the sliding portion 15 cannot swing in the opposite direction. Accordingly, the holding member 13 maintains the initial setting state shown in FIG. 6A.

In contrast, when the holding member 13 is moved forward as indicated by an arrow in FIG. 7A, the end edge 16*a* of the slant surface 16 becomes a trailing edge in the moving direction (the arrow direction). Due to the friction generated between the end edge 16*a* and the side surface 11*a* of the guide member 11, the end edge 16*a* is pulled in the direction opposite to the arrow direction, whereby the sliding portion 15 makes swing movement. In other words, when the sliding portion 15 makes an attempt to swing in the direction opposite to the direction indicated by an arrow in FIG. 7A as mentioned above, the thread coupling section 21 does not interferes with the screw shaft 10 and the engaging section 22 does not interfere with the guide rail 18. Therefore, the sliding portion 15 of the holding member 13 is swung in the direction opposite to the arrow direction as shown in FIG. 7A.

As described above, the first sliding surface 16 of the sliding portion 15, the guide member 11, the base portion 19 and the guide rail 18 make up a swing mechanism.

At least one of the second sliding surface 17 of the sliding portion 15 and the second sliding surface 11*c* of the guide member 11 is a slant surface which is inclined with respect to the plane direction of the surface of the dust-proof glass 5 (the horizontal direction) as shown in FIG. 6B. In the present embodiment, the second sliding surface 11*c* of the guide member 11 is a slant surface whose height position grows higher away from the dust-proof glass 5. The second sliding surface 17 of the sliding portion 15 is parallel to the surface of the dust-proof glass 5.

In the second sliding surface 17 of the sliding portion 15 and the second sliding surface 11*c* of the guide member 11, the protuberance 17*a* of the second sliding surface 17 makes contact with the outer region (the region distant from the dust-proof glass 5) of the second sliding surface 11*c* of the guide member 11 in the initial setting state shown in FIGS. 6A and 6B.

Figure 7B:
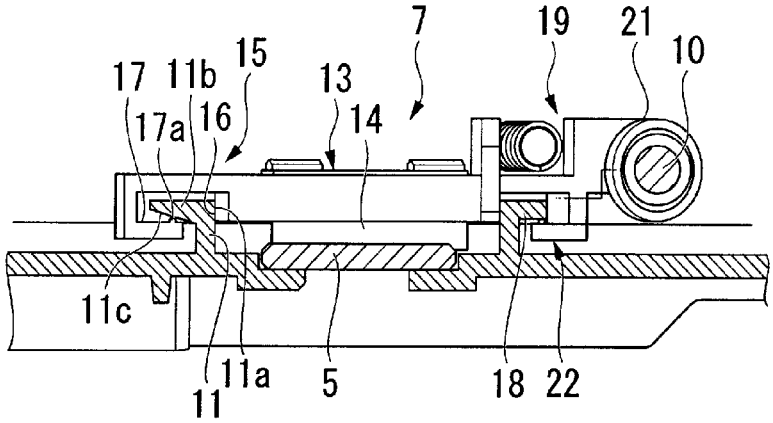
FIG. 7B is a front view showing the automatic cleaning unit and its vicinities.

In contrast, when the sliding portion 15 of the holding member 13 is swung in the direction opposite to the moving direction (the arrow direction) as shown in FIG. 7A, the end portion of the protuberance 17*a* of the second sliding surface 17 existing at the side opposite to the moving direction is displaced toward the dust-proof glass 5 by the swing movement of the sliding portion 15 as shown in FIG. 7B which is a front view showing the automatic cleaning unit 7 kept in the state shown in FIG. 7A and its vicinities. Thus, the end portion of the protuberance 17*a* of the second sliding surface 17 makes contact with the inner region (the region closer to the dust-proof glass 5) of the second sliding surface 11*c* of the guide member 11 which is kept stationary.

Since the second sliding surface 11*c* is a slant surface whose height grows higher away from the dust-proof glass 5, the sliding portion 15 of the automatic cleaning unit 7 is displaced downward with respect to the guide member 11 as the protuberance 17*a* displaces from the outer region of the second sliding surface 11*c* (the state shown in FIG. 6B) to the inner region of the second sliding surface 11*c* (the state shown in FIG. 7B). That is to say, the sliding portion 15 of the automatic cleaning unit 7 moves downward.

If the sliding portion 15 of the automatic cleaning unit 7 moves downward in this way, the cleaning member 14 installed in the holding member 13 moves downward, thereby pressing the dust-proof glass 5. On the other hand, in the initial setting state shown in FIG. 6B, the protuberance 17*a* is positioned in the outer region of the second sliding surface 11*c*, whereby the sliding portion 15 is positioned relatively high. Thus, the cleaning member 14 installed in the holding member 13 is positioned high and is kept in a state in which the cleaning member 14 does not press the dust-proof glass 5, namely in a state in which the cleaning member 14 makes little contact with the dust-proof glass 5. The cleaning member 14 may be kept in a state in which the cleaning member 14 does not make contact with the dust-proof glass 5.

The second sliding surface 17 (the protuberance 17*a*) of the sliding portion 15 and the second sliding surface 11*c* (the slant surface) of the guide member 11 make up a displacement conversion mechanism.

In the automatic cleaning mechanism 6 of the present embodiment, two of the four automatic cleaning units 7 are configured such that the sliding portion 15 of the holding member 13 is swung when the holding member 13 moves forward in the arrow direction shown in FIG. 7A but the sliding portion of the holding member 13 is not swung when the holding member 13 moves backward in the arrow direction shown in FIG. 7A. In contrast, the other two automatic cleaning units 7 are configured to operate in the opposite way.

Figure 8A:
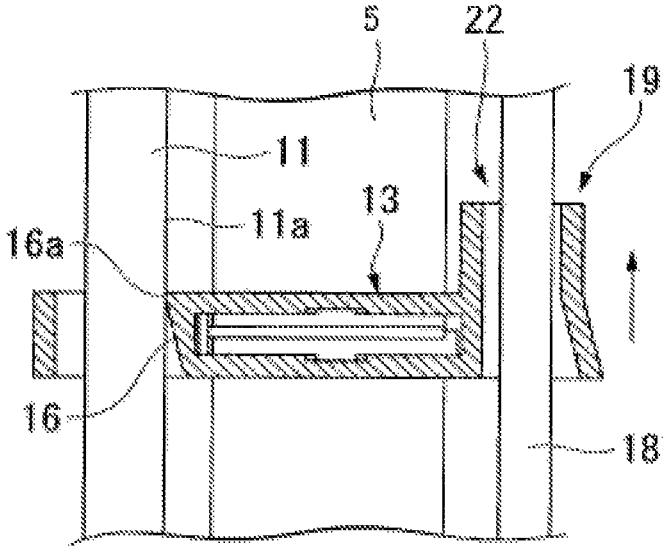
FIG. 8A is a view showing how the other two automatic cleaning units move forward.
Figure 8B:
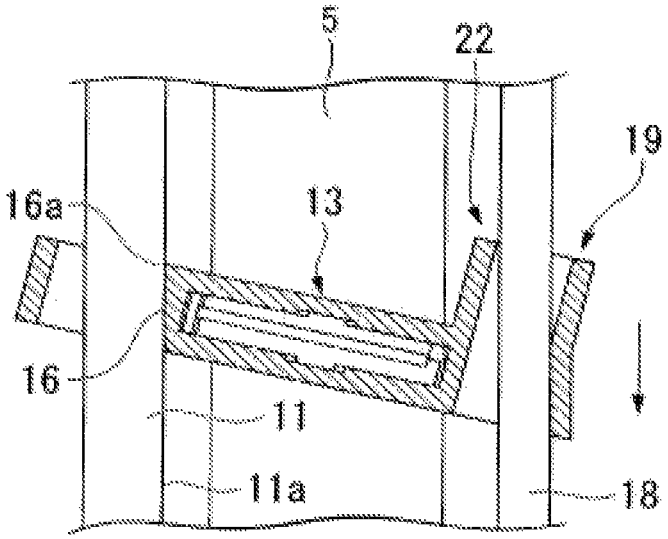
FIG. 8B is a view showing how the other two automatic cleaning units move backward.

More specifically, in the other two automatic cleaning units 7, as shown in FIGS. 8A and 8B, the inclination direction of the first sliding surface 16 is opposite to the inclination direction of the first sliding surface 16 shown in FIGS. 6A and 7A. Likewise, the configuration of the partially-omitted base portion 19 is opposite to the configuration of the base portion 19 shown in FIGS. 6A and 7A. Thus, the other two automatic cleaning units 7 are configured such that the sliding portion 15 of the holding member 13 is not swung when the holding member 13 moves forward in the arrow direction as shown in FIG. 8A but the sliding portion 15 of the holding member 13 is swung when the holding member 13 moves backward in the arrow direction as shown in FIG. 8A.

In the present embodiment, as described above, the screw shafts 10 of the respective automatic cleaning units 7 are driven by a single (one) drive motor 100 installed in the optical scanner 1. As shown in FIG. 1, the rotation of the drive motor 100 is transmitted to the respective screw shafts 10 via the gear train G arranged on one outer surface of the frame 2, whereby the respective screw shafts 10 are rotationally driven.

More specifically, a small-diameter gear G1 is attached to the output shaft of the drive motor 100 arranged at the longitudinal center of the frame 2. Large-diameter gears G2, G3 and G4 meshing with one another are symmetrically arranged about the gear G1 at the left and right sides of the gear G1. Small-diameter gears G6 are attached to one ends of the respective screw shaft 10. The gears G6 mesh with the gears G2 or the gears G4 by way of the gears G5.

The gear train G which transmits the rotation of the drive motor 100 to the screw shafts 10 of the respective automatic cleaning units 7 includes a plurality of gears G1 to G6 meshing with one another as mentioned above. Each of the gears G1 to G6 making up the gear train G is formed of a single-stage gear. The gears G1 to G6 are arranged along one outer surface of the frame 2.

In the meantime, if an image forming operation is repeatedly performed in a color image forming device, dirt or dust adheres to the surfaces of the dust-proof glasses 5 of the optical scanner (LSU) 1. Thus, optical properties are gradually deteriorated. For that reason, in the optical scanner of the present embodiment, the surfaces of the respective dust-proof glasses 5 are automatically cleaned by the four automatic cleaning units 7 of the automatic cleaning mechanism 6.

More specifically, if the drive motor 100 installed in the optical scanner 1 is driven, the rotation of the output shaft of the drive motor 100 is transmitted from the gear G1 to the two middle (cyan and yellow) screw shafts 10 via the gears G2, G5 and G6. Furthermore, the rotation of the gears G2 is transmitted to the two outer (magenta and black) screw shafts 10 via the gears G3, G4, G5 and G6. Thus, the four screw shafts 10 are rotationally driven at the same time and in the same direction.

If the four screw shafts 10 are rotationally driven at the same time and in the same direction, the holding members 13 threadedly coupled to the respective screw shafts 10 move along the main scanning direction of laser light, namely the long-side direction of the dust-proof glasses 5. In the present embodiment, the four screw shafts 10 are rotationally driven in the same direction due to the aforementioned arrangement of the gear train G, whereby the respective holding members 13 move at the same time and in the same direction. That is to say, the four holding members 13 move forward or backward at the same time. Consequently, the cleaning members 14 held by the respective holding members 13 move on the corresponding dust-proof glasses 5 along the long-side direction thereof.

At this time, in two of the four automatic cleaning units 7, if the holding members 13 are moved forward in the arrow direction as shown in FIG. 7A, the sliding portions 15 of the holding members 13 are swung and the sliding portions 15 are moved downward as shown in FIG. 7B. Thus, the cleaning members are also moved downward, thereby pressing the dust-proof glasses 5. If the holding members 13 are moved forward in the arrow direction shown in FIG. 7A in a state in which the cleaning members 14 press the dust-proof glasses 5, the cleaning members 14 move in the arrow direction shown in FIG. 7A while rubbing the surfaces of the dust-proof glasses 5. As a result, the cleaning members 14 remove the dirt or dust adhering to the surfaces of the dust-proof glasses 5, thereby cleaning the surfaces of the dust-proof glasses 5.

In contrast, in the other two automatic cleaning units 7, when the holding members 13 are moved forward in the arrow direction as shown in FIG. 8A, the sliding portions 15 of the holding members 13 are not swung. Thus, the sliding portions 15 are not moved downward and are kept in a relatively high position, namely in the initial setting state. For that reason, as described above, the cleaning members 14 are positioned relatively high and make little contact with the dust-proof glasses 5. Thus, the cleaning members 14 do not perform the cleaning of the surfaces of the respective dust-proof glasses 5.

When the four holding members 13 are moved backward at the same time, the swing mechanism including the slant surface as the first sliding surface 16 of the sliding portion 15 causes the swing and non-swing operations of the sliding portions 15 of the respective holding members 13 to become opposite to the swing and non-swing operations performed during the forward movement. In other words, in the two automatic cleaning units 7 whose holding members 13 were swung during the forward movement, no swing movement occur during the backward movement. Thus, the cleaning members 14 are positioned relatively high and do not perform the cleaning of the surfaces of the respective dust-proof glasses 5. On the other hand, in the remaining two automatic cleaning units 7 whose holding members 13 were not swung during the forward movement, swing movement occur during the backward movement. Thus, the cleaning members 14 are positioned relatively low, consequently cleaning the surfaces of the respective dust-proof glasses 5.

As described above, in the present embodiment, when the holding members 13 are moved by rotationally driving the four screw shafts 10 at the same time with the same drive motor 100, two of the four automatic cleaning units 7 can keep the height position of the cleaning members 14 relatively low so as to perform the cleaning of the dust-proof glasses 5 with the cleaning members 14 while the other two automatic cleaning units 7 can keep the height position of the cleaning members 14 relatively high so as not to perform the cleaning of the dust-proof glasses 5. It is therefore possible to reduce the load (torque) applied to the drive motor 100 during the cleaning process.

Accordingly, in the automatic cleaning mechanism 6 of the present embodiment, a motor which is relatively low in output power and proportionally low in price can be used as the drive motor 100. Thus, according to the present embodiment, it becomes possible to reduce the costs of the optical scanner 1 and the color image forming device (the image forming device) provided with the optical scanner 1.

By virtue of the displacement conversion mechanism, the swing direction displacement between the sliding portion 15 and the guide member 11 generated when the sliding portion 15 is swung by the swing mechanism is converted to the height direction displacement of the sliding portion 15 with respect to the guide member 11. Thus, the dust-proof glass 5 can be cleaned by displacing the sliding portion 15 so that the height of the sliding portion 15 with respect to the guide member 11 can become relatively low, pressing the cleaning member 14 held by the holding member 13 against the corresponding dust-proof glass 5, and moving the holding member 13 in that state.

When the holding members 13 are moved by rotationally driving a plurality of screw shafts 10 at the same time with the same drive motor 100, at least one of the automatic cleaning units 7 is configured such that the height of the sliding portions 15 displaced with respect to the guide members 11 by the displacement conversion mechanism differs from the height of the sliding portions 15 of the remaining automatic cleaning units 7. Thus, for example, the automatic cleaning mechanism 6 can be configured such that a certain automatic cleaning unit 7 keeps the height of the sliding portion 15 relatively low and performs the cleaning with the cleaning member 14 while the remaining automatic cleaning units 7 keep the height of the sliding portions 15 relatively high and release the pressing of the dust-proof glasses 5 by the cleaning members 14 so as not to perform the cleaning.

The protuberance 17*a* is formed on the second sliding surface 17 of the sliding portion 15 so that only the protuberance 17*a* of the sliding portion 15 can make sliding contact with the second sliding surface 11*c* of the guide member 11. Therefore, during the movement of the holding member 13, it is possible to reduce the sliding contact area between the second sliding surfaces 17 and 11*c* and to reduce the frictional force, thereby making the sliding movement smooth. Furthermore, only the protuberance 17*a* needs to be accurately formed without having to accurately form the entirety of the second sliding surface 17 of the sliding portion 15. This makes it possible to easily process the sliding portion 15 and to reduce the manufacturing costs.

While one preferred embodiment has been described above with reference to the drawings, the technology of the present disclosure is not limited to the foregoing embodiment. The shapes and combinations of the respective component members shown in the aforementioned embodiment are nothing more than one example and may be modified in many different forms according to design requirements without departing from the spirit of the technology of the present disclosure.

For example, in the present embodiment, the inclination directions of the slant surfaces as the first sliding surfaces 16 of the sliding portions 15 making up the swing mechanism are formed opposite to each other in certain two automatic cleaning units 7 and the remaining two automatic cleaning units 7. Thus, when the holding members 13 are moved at the same time, the cleaning members 14 of certain two automatic cleaning units 7 clean the dust-proof glasses 5 but the cleaning members 14 of the remaining two automatic cleaning units 7 do not clean the dust-proof glasses 5. However, instead of making the inclination directions of the slant surfaces of the first sliding surfaces 16 opposite to each other, the following technique may be employed as the method of dividing certain two automatic cleaning units 7 and the remaining two automatic cleaning units 7 which perform or do not perform the cleaning when the holding members 13 are moved at the same time.

Figure 9A:
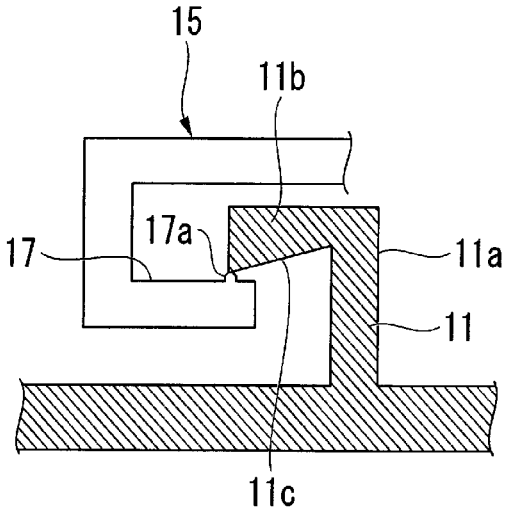
FIG. 9A is a view showing a displacement conversion mechanism according to a modified example, which is kept in an initial setting state.

In the present embodiment, the inclination directions of the second sliding surfaces 11*c* of the guide members 11 making up the displacement conversion mechanism are consistent in all of the four automatic cleaning units 7. Alternatively, the inclination direction shown in FIGS. 6B and 7B may be employed in certain two automatic cleaning units 7 while the opposite inclination direction as shown in FIG. 9A, namely the slant surface whose height grows higher toward the dust-proof glass 5, may be employed in the remaining two automatic cleaning units 7. The protuberance 17*a* of the second sliding surface 17 of the sliding portion 15 is formed so as to make contact with the second sliding surface 11*c* of the guide member 11 in the state shown in FIG. 9A, namely in the initial setting state.

Figure 9B:
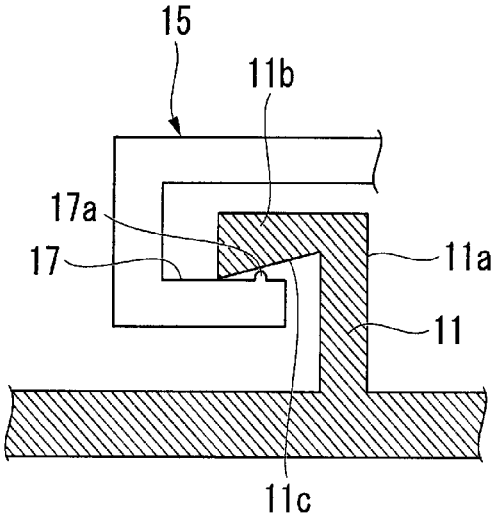
FIG. 9B is a view showing the displacement conversion mechanism according to the modified example, in which the sliding portion is in a rotated sate.

Thus, in the two automatic cleaning units 7 shown in FIG. 9A, if the holding member 13 is moved forward, the sliding portion 15 is swung and the protuberance 17*a* of the second sliding surface 17 is displaced toward the dust-proof glass 5 as shown in FIG. 9B, the protuberance 17*a* comes out of contact with the second sliding surface 11*c* of the guide member 11. The lower end of the second sliding surface 11*c* (the slant surface) of the guide member 11 comes into contact with the second sliding surface 17 of the sliding portion 15 positioned lower than the protuberance 17*a*. As a result, the sliding portion 15 is moved upward and the cleaning member 14 installed in the holding member 13 is also moved upward so as not to perform the cleaning of the dust-proof glass 5.

On the other hand, in the two automatic cleaning units 7 of the type shown in FIGS. 6B and 7B, the holding member 13 is moved forward and the sliding portion 15 thereof is swung as mentioned above. Consequently, the protuberance 17*a* of the second sliding surface 17 of the sliding portion 15 is displaced toward the dust-proof glass 5 as shown in FIG. 7B, whereby the cleaning member 14 is moved downward to clean the dust-proof glass 5.

When the four holding members 13 are moved backward at the same time, the displacement conversion mechanism including the slant surface as the second sliding surface 11*c* causes the relative vertical positions of the sliding portions 15 of the respective holding members 13 to become opposite to the relative vertical positions of the sliding portions 15 available during the forward movement of the holding members 13. That is to say, in the two automatic cleaning units 7 whose holding members 13 moved downward during the forward movement, the holding members 13 are positioned relatively high during the backward movement. Therefore, the cleaning members 14 are positioned relatively high and do not perform the cleaning of the surfaces of the respective dust-proof glasses 5.

On the other hand, in the remaining two automatic cleaning units 7 whose holding members 13 moved upward during the forward movement, the holding members 13 are positioned relatively low during the backward movement. Therefore, the cleaning members 14 are positioned relatively low and perform the cleaning of the surfaces of the respective dust-proof glasses 5.

Therefore, with this configuration, when the holding members 13 are moved by rotationally driving the four screw shafts 10 at the same time with the same drive motor 100, two of the four automatic cleaning units 7 can keep the height position of the cleaning members 14 relatively low so as to perform the cleaning of the dust-proof glasses 5 with the cleaning members 14 while the other two automatic cleaning units 7 can keep the height position of the cleaning members 14 relatively high so as not to perform the cleaning of the dust-proof glasses 5. It is therefore possible to reduce the load (torque) applied to the drive motor 100 during the cleaning process.

Accordingly, in the automatic cleaning mechanism 6 of the present example, a motor which is relatively low in output power and proportionally low in price can be used as the drive motor 100. Thus, according to the present example, it becomes possible to reduce the costs of the optical scanner 1 and the color image forming device (the image forming device) provided with the optical scanner 1.

As another example (technique), it is possible to use a technique in which, when the holding members 13 are moved by rotationally driving the four screw shafts 10 at the same time with the same drive motor 100, the rotation direction of the screw shafts 10 of two of the automatic cleaning units 7 is made opposite to the rotation direction of the screw shafts 10 of the other two automatic cleaning units 7. For example, in two of the automatic cleaning units 7, the holding members 13 are moved forward so that the cleaning can be performed as shown in FIGS. 7A and 7B. In the other two automatic cleaning units 7, the holding members 13 are moved backward so that the cleaning should not be performed as shown in FIGS. 6A and 6B.

Figure 10:
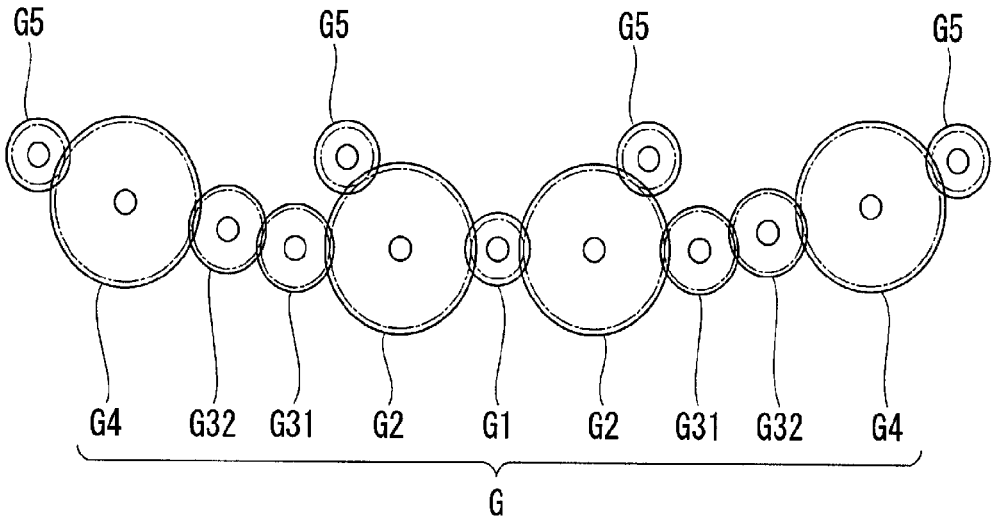
FIG. 10 is a view schematically showing a modified example of the gear train.

As a specific embodiment for carrying out this technique, for example, the gear train G shown in FIG. 1 may be changed as illustrated in FIG. 10. More specifically, each of the gears G3 shown in FIG. 1 are divided into two gears G31 and G32 as illustrated in FIG. 10, whereby the screw shafts 10 corresponding to the gears G2 and screw shafts 10 corresponding to the gears G4 can be rotated at the same time but in the mutually opposite directions. Consequently, the holding members 13 of the automatic cleaning units 7 including the screw shafts 10 corresponding to the gears G2 and the holding members 13 of the automatic cleaning units 7 including the screw shafts 10 corresponding to the gears G4 can be moved in the mutually opposite directions.

With this configuration, when the holding members 13 are moved by rotationally driving the four screw shafts 10 at the same time with the same drive motor 100, two of the four automatic cleaning units 7 can keep the height position of the cleaning members 14 relatively low so as to perform the cleaning of the dust-proof glasses 5 with the cleaning members 14 while the other two automatic cleaning units 7 can keep the height position of the cleaning members 14 relatively high so as not to perform the cleaning of the dust-proof glasses 5. It is therefore possible to reduce the load (torque) applied to the drive motor 100 during the cleaning process. Accordingly, in the automatic cleaning mechanism 6 of the present example, a motor which is relatively low in output power and proportionally low in price can be used as the drive motor 100. Thus, according to the present example, it becomes possible to reduce the costs of the optical scanner 1 and the color image forming device (the image forming device) provided with the optical scanner 1.

In the embodiment and modified examples described above, the height positions of the cleaning members 14 with respect to the dust-proof glasses 5 are differently set in two of the four automatic cleaning units 7 and in the other two automatic cleaning units 7. When the holding members 13 are moved, one of certain two automatic cleaning units 7 and the remaining two automatic cleaning units 7 performs cleaning while the other of certain two automatic cleaning units 7 and the remaining two automatic cleaning units 7 does not perform cleaning. Thus, the load (torque) applied to the drive motor 100 during the cleaning process is reduced. Alternatively, only one of the four automatic cleaning units 7 may be configured to differ in operation from the remaining three automatic cleaning units 7. Even in that case, it is possible to reduce the load (torque) applied to the drive motor 100. Accordingly, it becomes possible to use an inexpensive motor.

In the embodiment and modified examples described above, description has been made on an example in which the automatic cleaning mechanism 6 is provided with four automatic cleaning units 7. However, the automatic cleaning mechanism of the technology of the present disclosure may include a plurality of automatic cleaning units 7 other than four. In this case, it is preferred that at least one automatic cleaning unit 7 is configured to differ in operation from the remaining automatic cleaning units 7.

Figure 11:
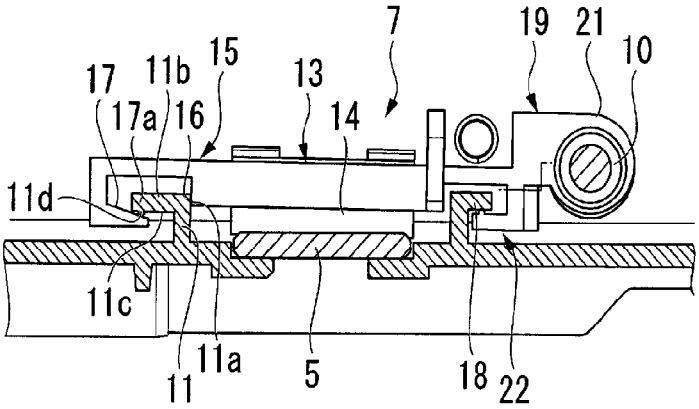
FIG. 11 is a front view showing an automatic cleaning unit according to a modified example and its vicinities.

In the aforementioned embodiment, the displacement conversion mechanism is configured such that, as shown in FIGS. 6B and 7B, the second sliding surface 11*c* of the guide member 11 becomes a slant surface. As an alternative example, the second sliding surface 17 of the sliding portion 15 may become a slant surface as shown in FIG. 11. In this case, it is preferred that a protuberance 11*d* is formed on the second sliding surface 11*c* of the guide member 11. By forming the protuberance 11*d* in this manner, it is possible to obtain the same effects as provided by the protuberance 17*a*.

The displacement conversion mechanism may be configured by forming both the second sliding surface 11*c* of the guide member 11 and the second sliding surface 17 of the sliding portion 15 into slant surfaces, instead of forming only one of the second sliding surface 11*c* of the guide member 11 and the second sliding surface 17 of the sliding portion 15 into a slant surface. In the aforementioned embodiment, the protuberance 17*a* is formed on the second sliding surface 17. However, it may be possible to omit the formation of the protuberance 17*a*.

What is claimed is:

1. An optical scanner, comprising:

a frame configured to accommodate a plurality of scanning optical systems for emitting latent-image-writing light toward an image carrier and provided with a plurality of emission ports through which the light emitted from the scanning optical systems passes;

a plurality of dust-proof glasses configured to cover the emission ports; and a plurality of automatic cleaning units respectively driven by one drive source to clean the dust-proof glasses, wherein each of the automatic cleaning units includes a screw shaft arranged to extend along each of the dust-proof glasses and rotationally driven by the drive source, a holding member to which the screw shaft is threadedly coupled, and a cleaning member held by the holding member and configured to, when the screw shaft is rotationally driven, move together with the holding member along each of the dust-proof glasses to clean each of the dust-proof glasses, wherein the automatic cleaning units are configured such that, when the holding members of the automatic cleaning units are moved by rotationally driving the screw shafts of the automatic cleaning units at the same time, the height of the cleaning member of at least one of the automatic cleaning units with respect to each of the dust-proof glasses becomes different from the height of the cleaning members of the remaining automatic cleaning units with respect to the dust-proof glasses.

2. The optical scanner of claim 1, wherein each of the automatic cleaning units includes a guide member arranged at the opposite side of each of the dust-proof glasses from the screw shaft so as to extend along each of the dust-proof glasses, a sliding portion installed in the holding member at the opposite side of each of the dust-proof glasses from the screw shaft and configured to slidably engage with the guide member, a swing mechanism installed in an engaging section of the sliding portion and the guide member and configured to, when the holding member is moved forward or backward by the rotational driving of the screw shaft, swing the sliding portion in a direction opposite to a moving direction of the holding member, and a displacement conversion mechanism installed in the engaging section of the sliding portion and the guide member and configured to convert a swing direction displacement between the sliding portion and the guide member, which is generated when the sliding portion is swung by the swing mechanism, to a height direction displacement of the sliding portion with respect to the guide member, wherein, when the holding members of the automatic cleaning units are moved by rotationally driving the screw shafts of the automatic cleaning units at the same time, at least one of the automatic cleaning units causes the height of the sliding portion thereof displaced with respect to the guide member by the displacement conversion mechanism to become different from the height of the sliding portions of the remaining automatic cleaning units, thereby causing the height of the cleaning member thereof with respect to the corresponding dust-proof glass to become different from the height of the cleaning members of the remaining automatic cleaning units.

3. The optical scanner of claim 2, wherein the swing mechanism includes a first sliding surface of the sliding portion which makes sliding contact with the guide member, the first sliding surface being a slant surface which is inclined with respect to the moving direction of the holding member in an initial setting state in which the sliding portion is not swung.

4. The optical scanner of claim 2, wherein the displacement conversion mechanism includes a second sliding surface of the guide member and a second sliding surface of the sliding portion which make sliding contact with each other, at least one of the second sliding surfaces being a slant surface.

5. The optical scanner of claim 4, wherein a protuberance which makes sliding contact with the second sliding surface of the guide member is formed on the second sliding surface of the sliding portion.

6. The optical scanner of any one of claims 2, wherein, when the screw shafts of the automatic cleaning units are rotationally driven at the same time by the drive source, the screw shaft of at least one of the automatic cleaning units is configured to rotate in a direction opposite to a rotation direction of the screw shafts of the remaining automatic cleaning units.

7. The optical scanner of claim 3, wherein the inclination direction of the slant surface which forms the first sliding surface of at least one of the automatic cleaning units is opposite to the inclination direction of the slant surfaces of the remaining automatic cleaning units.

8. The optical scanner of claim 4, wherein the inclination direction of the slant surface which forms one of the second sliding surfaces of at least one of the automatic cleaning units is opposite to the inclination direction of the slant surfaces of the remaining automatic cleaning units.

9. An image forming device, comprising the optical scanner of claim 1.

* * * * *